US007527012B2

(12) United States Patent
Kutny Splaine

(10) Patent No.: US 7,527,012 B2
(45) Date of Patent: May 5, 2009

(54) PADDLE CLIP AND METHOD FOR USING SAME

(76) Inventor: Deborah Kutny Splaine, 228 Asharoken Ave., Northport, NY (US) 11768

( * ) Notice: Subject to any disclaimer, the term of this patent is extended or adjusted under 35 U.S.C. 154(b) by 145 days.

(21) Appl. No.: 11/879,380

(22) Filed: Jul. 17, 2007

(65) Prior Publication Data

US 2008/0016658 A1 Jan. 24, 2008

Related U.S. Application Data

(60) Provisional application No. 60/831,633, filed on Jul. 18, 2006.

(51) Int. Cl.

| | |
|---|---|
| ***B63B 17/00*** | (2006.01) |
| ***B63H 16/06*** | (2006.01) |
| ***A44B 21/00*** | (2006.01) |
| ***B60R 7/08*** | (2006.01) |

(52) U.S. Cl. ..... 114/343; 114/364; 440/104; 24/336; 24/339; 24/530; 224/406; 224/536

(58) Field of Classification Search ..... 114/343, 114/347, 364; 440/101–110; 24/336, 338, 24/339, 456, 457, 499, 520, 530, 545; 224/406, 224/511, 536, 922

See application file for complete search history.

(56) References Cited

U.S. PATENT DOCUMENTS

| | | | | |
|---|---|---|---|---|
| 2,734,205 | A * | 2/1956 | Preiss | 114/364 |
| 2,869,812 | A * | 1/1959 | Hamel | 248/511 |
| 4,453,490 | A * | 6/1984 | Miller | 114/364 |
| D375,890 | S * | 11/1996 | Takai | D8/380 |
| 6,408,492 | B1 * | 6/2002 | Sparks et al. | 24/336 |
| 6,755,145 | B2 * | 6/2004 | Bolebruch | 114/347 |
| 6,823,564 | B2 | 11/2004 | Gorman et al. | |
| D508,842 | S * | 8/2005 | Paolini | D8/395 |
| 7,004,100 | B1 * | 2/2006 | Rard et al. | 114/347 |
| 7,181,806 | B2 | 2/2007 | Folkmar | |
| 7,213,362 | B1 | 5/2007 | Weber | |

* cited by examiner

*Primary Examiner*—Ajay Vasudeva
(74) *Attorney, Agent, or Firm*—David Aker

(57) ABSTRACT

A paddle clip for a human powered watercraft, comprising a first flexible resilient portion with an opening to fit around the gunwale or cockpit rim of the watercraft. A second portion of the paddle clip includes a flexible portion for removably receiving a cylindrical shaft of an oar or a paddle used for propelling the watercraft. The paddle clip may further comprise at least one accessory clip for receiving an additional cylindrical shaft or an accessory. The paddle clip is configured to be quickly installed, repositioned or removed from the watercraft without tools or hardware.

13 Claims, 3 Drawing Sheets

PADDLE CLIP AND METHOD FOR USING SAME

This application claims priority under 35 U.S.C. §119(e) from provisions patent application Ser. No. 60/831,633 filed on Jul. 18, 2006 which is incorporated herein by reference, in its entirety.

BACKGROUND OF THE INVENTION

1. Field of the Invention

The present invention relates to an article of manufacture or a clip to securely hold an oar or paddle hands free while entering, exiting or performing other tasks while using a kayak, canoe or other human powered watercraft. In particular, it relates to a paddle clip that serves to make entering or exiting a personal watercraft easier, such that the oar or paddle is securely attached to the watercraft, and people with difficulty entering or exiting the watercraft will have the use of both of their hands to assist with the task.

2. Prior Art

An oar or paddle for use with kayak, canoe and human powered watercraft, is compromised of an elongate shaft having a first end and a second end, at least one end of the shaft having a blade attached thereto. A kayak, canoe or human powered watercraft is designed to hold one to three persons within a cockpit of the watercraft the top rim of the cockpit being the gunwale or cockpit rim of the watercraft.

The conventional method of entering a kayak watercraft is to hold the paddle with one hand grasping the shaft of the paddle somewhere midway on the paddle shaft, and while holding the paddle with one hand, enter the watercraft with one leg and then the other leg, with only one hand to assist in this motion. This motion causes significant unbalance to the person that may cause a fall of the person into the water or onto the watercraft. Furthermore, this fall may cause contusions (bruising) or significant injury or death to the person.

People with disabilities of the hand and wrist or back (for example carpal tunnel syndrome, tendon injuries and spine injuries) may be unable or too uncomfortable to hold a tight grip on the paddle with one hand while entering the watercraft.

Current paddle clips must be attached to the watercraft by drilling holes in the watercraft and attaching the clips with hardware such as screws and bolts. These clips are permanent in place and to reposition they must be unscrewed and new holes must be drilled to move the clips to a new position. The holes in the watercraft cause permanent damage to the watercraft.

Current paddle clips do not have any accommodations to hold additional accessories.

SUMMARY OF THE INVENTION

The present invention overcomes at least in part some of the aforementioned disadvantages.

It is an object of the invention to provide a paddle clip that securely holds a paddle, thus enabling the user to comfortably enter a watercraft.

It is a further object of the invention to provide a paddle clip that is easily installed on the gunwale or cockpit rim of the watercraft without the use of tools, additional hardware, drilling holes or damage to the watercraft.

It is a further object of the invention to provide a paddle clip that is compact in size.

It is further object of the invention to provide a paddle clip that is easily repositioned to any aspect or position on the watercraft gunwale or cockpit rim without tools additional hardware or damage to the watercraft.

It is another object of the invention to be able to use one or more paddle clips anywhere on the gunwale or cockpit rim of the watercraft depending on the users' desires.

It is another object of the invention to have additional smaller clips on either side of the main paddle clip to hold other accessories.

In accordance with the first aspect of the present invention there is provided one paddle clip for use with a kayak, canoe or similar watercraft paddle. The paddle clip may be attached by the user (paddler) by sliding and clipping one paddle clip over the gunwale or cockpit rim of the watercraft into any position along the gunwale or cockpit rim applicable to the user (paddler). The user may use one or several clips along the boat gunwale or cockpit rim depending on the boat and paddle design.

Furthermore, these paddle clips are fabricated from molded plastic, hard rubber or metal material.

In accordance with the invention a paddle clip is comprised of one piece molded plastic. The paddle clip having two main portions one for clipping onto the gunwale or cockpit rim of the watercraft and one for clipping in and holding the paddle shaft. Additionally, the clip can have two smaller clips adjacent to the clip that holds the paddle shaft, for clipping in other accessories. The smaller clips can be sized for fishing poles and other related accessories. The width of each manufactured clip can range from one quarter inch to three inches depending on the model of the watercraft and paddle being used. The clip is designed to securely hold a paddle while the person is entering, exiting or using a kayak, canoe or other human powered watercraft.

The paddle clip is preferably fabricated from molded ultraviolet stabilized polypropylene, which is flexible enough to expand over the gunwale or cockpit rim and the paddle shaft yet rigid enough to securely grip the gunwale or cockpit rim and the paddle shaft when contracted. The plastic can be inexpensive to obtain and to manufacture into the paddle clip.

Installing the paddle clip to the watercraft only requires slightly expanding the bottom portion of the clip with the user's hands and just sliding the clip over the gunwale or cockpit rim of the watercraft, and releasing to secure the clip to the watercraft. This installation is accomplished without the use of any tools, additional hardware or damage to the watercraft.

The paddle clip further has another flexible clip portion on the upper region to hold the paddle shaft in the same manner. The user merely snaps the paddle shaft into this upper clip to securely hold the paddle.

The paddle clip of the invention enables the user to securely hold the paddle to leave the hands free while performing other tasks such as having a drink or fishing. One of the important advantages of the invention is that, it relates to the lack of any tools or additional hardware needed to attach the clip to the gunwale or cockpit rim of kayaks, canoes and human powered watercraft. More particularly, the clip is small, compact, movable to any position on the gunwale or cockpit rim and removable quickly (in just seconds) without any tools or damage to the watercraft. Additionally, the clip has two smaller auxiliary clips on ether side of the larger center clip to clip in other accessories such as fishing poles and dry bags.

BRIEF DESCRIPTION OF THE DRAWINGS

The foregoing aspects and other features of the present invention are explained in the following description, taken in connection with the accompanying drawings, wherein like numerals indicate like elements, and wherein.

DETAILED DESCRIPTION OF THE PREFERRED EMBODIMENTS

Figure 1:
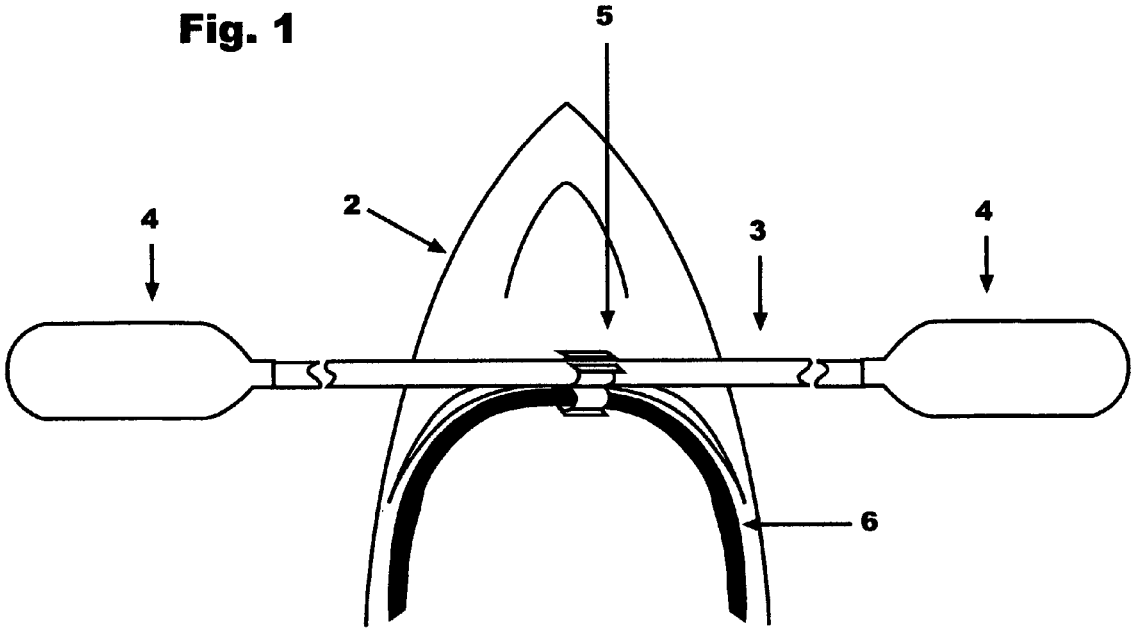
FIG. 1 is a perspective view showing an embodiment of the article of manufacture in accordance with the invention in place, for use, on the gunwale or cockpit rim of the watercraft.

FIG. 1 is a diagrammatic view of a portion of a kayak or similar watercraft 2 with a paddle 3 (the paddle shaft having a blade 4 on either end) or a canoe or similar watercraft with paddle (the paddle shaft having a blade on one end) incorporating an embodiment of a paddle clip 5 of the present invention in place on the gunwale or cockpit rim 6 of a kayak 2. The paddle 3 is clipped in place on the paddle clip 5 of, for example, the small boat or watercraft 2, such as a kayak, by a person who is entering, exiting, or otherwise occupied, so as not to immediately need the paddle.

Figure 2:
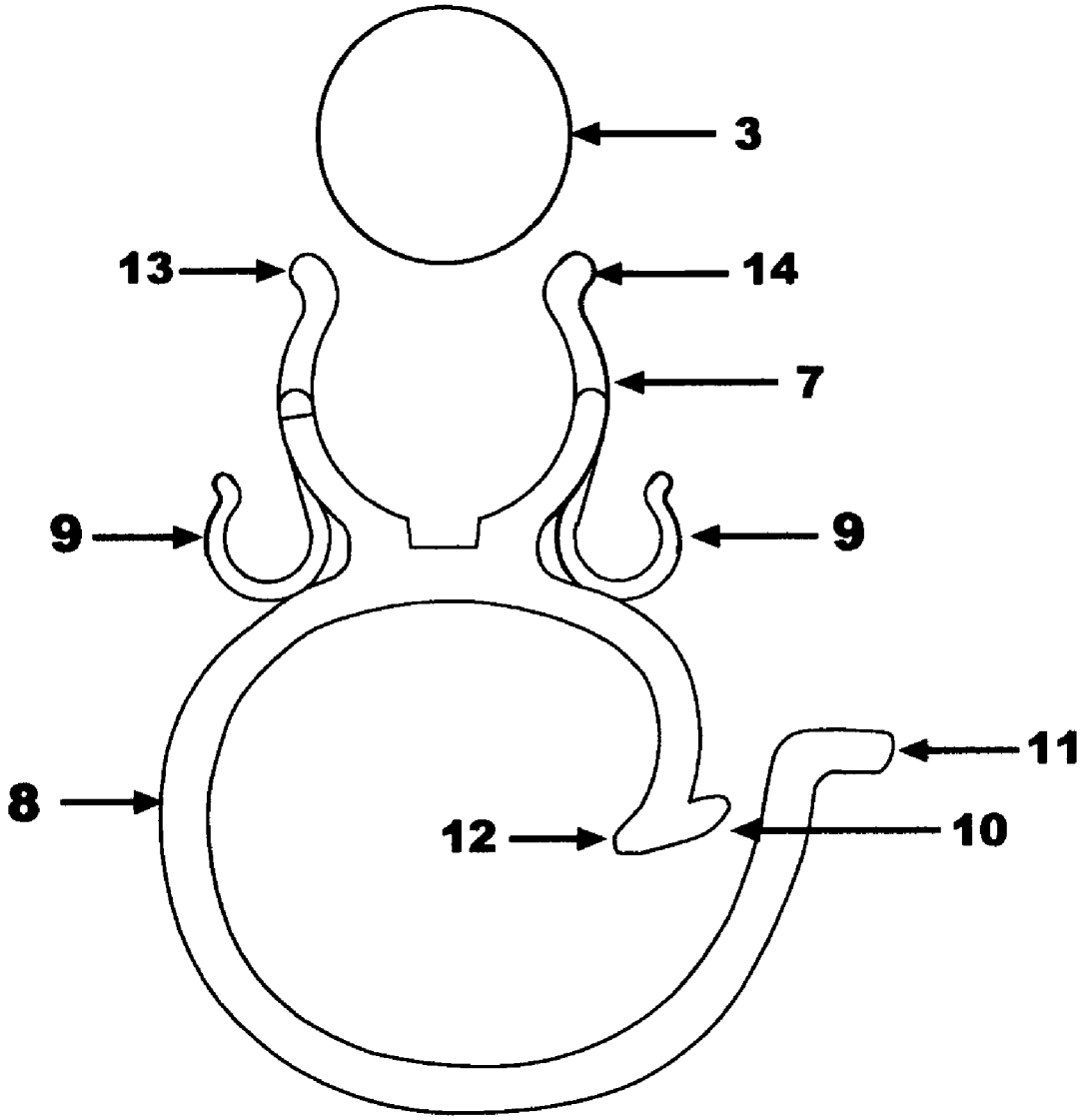
FIG. 2 is a cross sectional view of an embodiment of the invention in the closed position.

FIG. 2 is a cross sectional view of an embodiment of the invention with the bottom portion of the invention which grips the gunwale in the closed position, and showing the top and main clip portion 7 of the paddle clip 5 where the paddle shaft 3 is placed. The lower portion 8 of the paddle clip, which can expand to surround a portion of the gunwale or cockpit rim of the watercraft, is in the closed, or non-flexed position having an opening 10 with a width of approximately 0.125 inches which, due to flexibility of the clip, may be increased in width from to approximately 2 inches. Opening 10 is defined by a first edge having a lip 11 and said second edge having a protrusion 12 extending generally toward said first edge.

The flexible members 13 and 14 defining the top or main clip portion 7 have flared ends, which extend in a general direction away from one another at their tops to facilitate placement of the shaft 3 of the oar or paddle between flexible members 13 and 14. This portion of the paddle clip has an entrance when not flexed of 0.75 inches, to 1.25 inches when flexed by the insertion of the shaft 3 of an oar or paddle. The portion that surrounds and securely holds the shaft 3 of the oar or paddle until it is removed, when the flexible members are again flexed, is preferably designed to securely receive an oar or paddle having a shaft with a diameter of 1.125 inches through 1.25 inches, although other dimensions may be necessary for shafts of different size.

FIG. 2 also shows accessory clips 9 adjacent to the main clip portion 7. The two additional accessory clips 9 preferably have an inside diameter of 0.750 inch and can flex for at least an additional 0.125 inch to securely hold other accessories, such as portions of fishing equipment.

Figure 3:
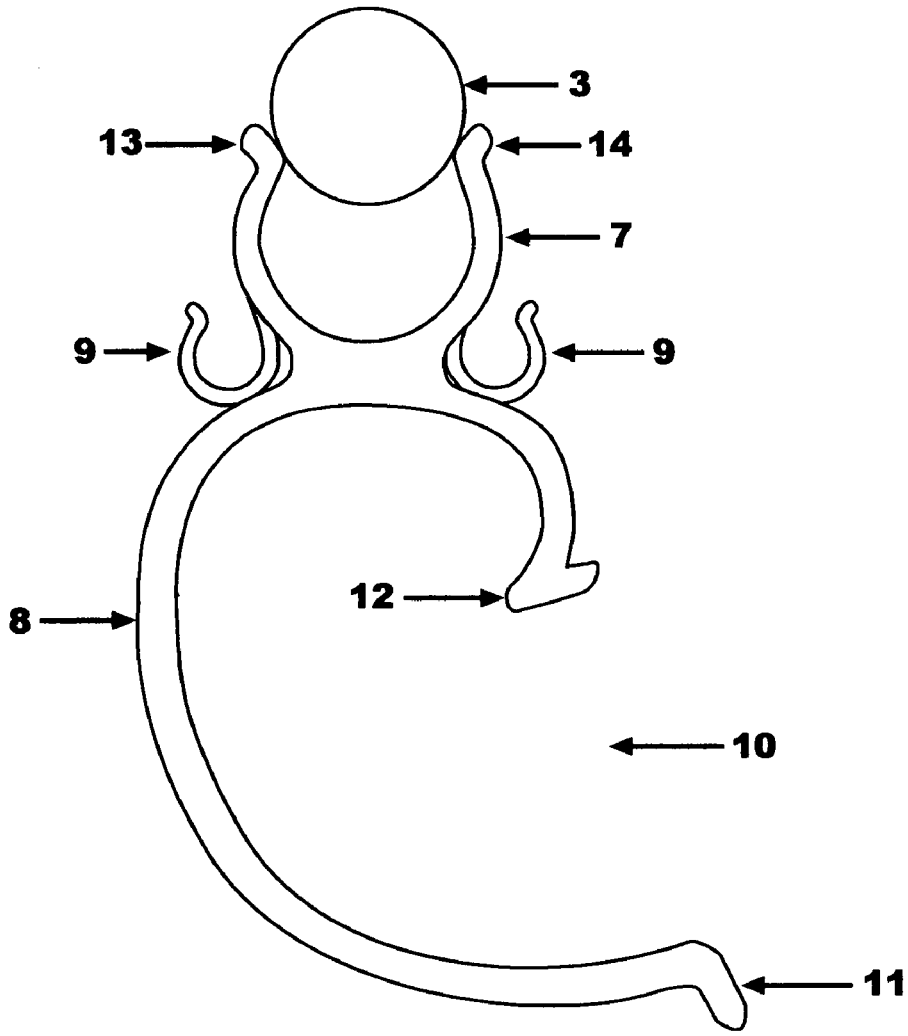
FIG. 3 is a cross section view of the embodiment of the invention in the expanded position.

FIG. 3 is a cross sectional view of the invention in the open position, showing the top portion of the paddle clip 7 is flexed by the insertion of the shaft 3 of an oar or paddle. The lower portion 8 of the paddle clip expanded to slide over the watercraft gunwale or cockpit rim in the open position having an opening of up to 2.00 inches. Also noted are the accessory clips. 9 adjacent to the main clip 7.

In use a paddle clip in accordance with the invention the paddle clip is held with both hands expanding the lower portion of the paddle clip and sliding the paddle clip around the watercraft gunwale or cockpit rim. Then the user releases the paddle clip to provide a secure hold on the watercraft.

The user then clips the paddle into the larger clip of the upper portion of the paddle clip by applying slight downward pressure. Attaching accessories to the smaller clip is done in the same manner.

The user then enters the watercraft and applies gentle upward pressure to release the paddle from the paddle clip for use.

The paddle clip may be slid in a clockwise or counterclockwise motion to reposition the clip on the watercraft gunwale or cockpit rim.

The paddle clip may also be removed by expanding the bottom portion of the paddle clip and sliding it off the gunwale or cockpit rim of the watercraft. The user would then be performing the reverse of the installing motion.

If left on the watercraft while paddling, the user may clip the paddle into the paddle clip to securely hold it while using both of their hands for another activity such as having a drink or fishing.

The ability of the paddle clip to be positioned anywhere on the gunwale or cockpit rim of the watercraft enables the user flexibility in securely fastening their paddle when not in use. The accessory clips are also able to securely hold other items while the user is paddling.

The paddle clips of the present invention may be made by injection molding of an appropriate polymer, such as a high strength plastic material or a hard rubber. The paddle clip may also be made from a thin spring-like metal. All of the parts described above may integrally formed as a single unit. If made of metal, the metal may be coated, for example by dip coating, with an appropriate polymer to prevent corrosion.

Although the present invention is described with reference to the embodiments shown in the drawings, it should be understood that the present invention can be embodied in many alternate forms of embodiments. In addition, any suitable size, shape or type of elements or materials could be used. In addition, although the paddle clip of the present invention is shown on the gunwale or cockpit rim of a kayak, canoe or watercraft it will be understood that they may be used on many kinds of other edges where shafts or pipes are to be attached.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An oar or paddle attachment system on a human powered watercraft, comprising:

a watercraft having a cockpit rim; and a paddle clip detachably attached on the cockpit rim, the paddle clip further comprising:

a first portion having a substantially arcuate shape and an expandable opening, the first portion being flexible and resilient for a secure grip so that when flexed the first portion is configured to fit on the cockpit rim of the watercraft with a portion of the cockpit rim being received through the opening in the first portion, wherein the opening in the first portion is defined by a first edge and a second edge, the first edge having a lip and the second edge having a protrusion extending toward the first edge;

a second portion having a substantially arcuate shape, the second portion including a flexible resilient clip portion with an opening and configured for removably accommodating a cylindrical shaft of an oar or a paddle, wherein the opening of the clip portion has flared ends and is oriented substantially away from the opening in the first portion to facilitate an accommodation and orientation of the oar or the paddle; and first and second accessory clips disposed adjoining and on opposing sides of the clip portion of the second portion for accommodating a cylindrical shaft, the first and second accessory clips each having a substantially arcuate shape and a flared opening, the accessory clips being sized to be substantially smaller than the second portion, the flared openings of the accessory clips being oriented substantially in the direction of the opening of the clip portion of the second portion.

2. The attachment system of claim 1, wherein the watercraft is a kayak or a canoe.

3. The attachment system of claim 1, wherein said first portion is sized and shaped so as to be expanded when being positioned on the cockpit rim, and to contract for an accurate fit about the cockpit rim.

4. The attachment system of claim 1, wherein said first portion and said second portion are integrally formed.

5. The attachment system of claim 1, wherein said first portion and said second portion are integrally formed of a material selected from the group consisting of a molded plastic, hard rubber and metal.

6. The attachment system of claim 1, wherein said second portion is configured with respect to said first portion so that the cylindrical shaft of said oar or paddle is held in a direction generally parallel to the cockpit rim at the location of the paddle clip.

7. The attachment system of claim 1, wherein said paddle clip is configured for connecting to the watercraft without tools or hardware.

8. The attachment system of claim 1, wherein said paddle clip is configured for connection to the watercraft without drilling holes or otherwise damaging the watercraft.

9. The attachment system of claim 1, wherein said paddle clip is configured to be rapidly installed, repositioned or removed from the watercraft.

10. The attachment system of claim 1, wherein said paddle clip is configured to be installed or moved to accommodate either right handed or left handed users.

11. The attachment system of claim 1, wherein said first portion is sized and shaped to fit cockpit rims having different dimensions.

12. A method of using the attachment system of claim 1, comprising installing the first portion about the cockpit rim of the watercraft; and inserting the cylindrical shaft of the oar or paddle in the clip portion.

13. The method of using the attachment system of claim 12, further comprising removing the cylindrical shaft of the oar or paddle from the clip portion in order to use the oar or paddle.

* * * * *